US009739521B2

(12) United States Patent
Kawai et al.

(10) Patent No.: US 9,739,521 B2
(45) Date of Patent: Aug. 22, 2017

(54) AIR CONDITIONING APPARATUS

(71) Applicant: Fujitsu General Limited, Kawasaki-shi (JP)

(72) Inventors: Keito Kawai, Kawasaki (JP); Hideya Tamura, Kawasaki (JP); Takahiro Matsunaga, Kawasaki (JP); Shinju Watanabe, Kawasaki (JP); Takashi Kimura, Kawasaki (JP); Kotaro Toya, Kawasaki (JP); Yasuhiro Oka, Kawasaki (JP); Ken Nakashima, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 627 days.

(21) Appl. No.: 13/733,697

(22) Filed: Jan. 3, 2013

(65) Prior Publication Data

US 2013/0192284 A1 Aug. 1, 2013

(30) Foreign Application Priority Data

Jan. 31, 2012 (JP) ..... 2012-017757

(51) Int. Cl.
*F25B 1/00* (2006.01)
*F25B 43/02* (2006.01)
(Continued)

(52) U.S. Cl.
CPC ..... *F25D 21/06* (2013.01); *F25B 13/00* (2013.01); *F25B 31/004* (2013.01);
(Continued)

(58) Field of Classification Search
CPC ..... F25D 21/06; F25B 47/02; F25B 2700/11; F25B 47/022; F25B 13/00; F25B 47/025
(Continued)

(56) References Cited

U.S. PATENT DOCUMENTS 5,156,014 A * 10/1992 Nakamura ..... F24F 3/065 62/160
2005/0189431 A1* 9/2005 Nakayama ..... F24H 4/04 237/12
2010/0107661 A1* 5/2010 Awwad ..... B60H 1/321 62/80
2012/0192581 A1* 8/2012 Kasagi ..... F25B 31/004 62/192

FOREIGN PATENT DOCUMENTS

JP H02-195145 A 8/1990
JP 0820140 B2 * 3/1996
(Continued)

OTHER PUBLICATIONS

Extended European Search Report issued in European Patent Application No. 12199615.1 dated Nov. 4, 2013.
(Continued)

*Primary Examiner* — Frantz Jules
*Assistant Examiner* — Meraj A Shaikh
(74) *Attorney, Agent, or Firm* — Venable LLP; Michael A. Santori

(57) ABSTRACT

When the temperatures of outdoor heat exchangers 23*a* and 23*b* detected by outdoor heat exchanger temperature sensors 57*a* and 57*b* become equal to or higher than 5 degrees C. and the sucking superheating degrees of compressors 21*a* and 21*b* become equal to or lower than 0 degrees C. while an air conditioning apparatus 1 is performing the reverse defrosting operation, the reverse defrosting operation is stopped and the heating dominant operation is resumed. At this time, the total operating times of the compressors 21*a* and 21*b* are reset. The sucking superheating degrees of the compressors 21*a* and 21*b* are obtained by subtracting the low pressure saturation temperatures calculated from the sucking pressures of the compressors 21*a* and 21*b*, from the temperatures of the refrigerants sucked into the compressors 21*a* and 21*b* which temperatures are detected by the sucking temperature sensors 54*a* and 54*b*.

6 Claims, 3 Drawing Sheets

(51) Int. Cl.

| | |
|---|---|
| ***F25B 27/00*** | (2006.01) |
| ***F25B 5/02*** | (2006.01) |
| ***F25D 21/06*** | (2006.01) |
| ***F25B 13/00*** | (2006.01) |
| ***F25B 31/00*** | (2006.01) |
| ***F25B 47/02*** | (2006.01) |

(52) U.S. Cl.
CPC ..... *F25B 47/025* (2013.01); *F25B 2313/027* (2013.01); *F25B 2313/0231* (2013.01); *F25B 2313/0253* (2013.01); *F25B 2313/02532* (2013.01); *F25B 2313/0314* (2013.01); *F25B 2313/0315* (2013.01); *F25B 2700/1931* (2013.01); *F25B 2700/1933* (2013.01); *F25B 2700/2104* (2013.01); *F25B 2700/2106* (2013.01); *F25B 2700/21151* (2013.01); *F25B 2700/21152* (2013.01)

(58) Field of Classification Search
USPC ..... 62/156
See application file for complete search history.

(56) References Cited

FOREIGN PATENT DOCUMENTS

| | | | | |
|---|---|---|---|---|
| JP | 10288410 | A | * | 10/1998 |
| JP | H10-288410 | A | | 10/1998 |
| JP | 2005-351598 | A | | 12/2005 |
| JP | 2006300374 | A | * | 11/2006 |
| JP | 2009-228928 | A | | 10/2009 |
| JP | 2009228928 | A | * | 10/2009 |
| JP | 2011-149659 | A | | 8/2011 |
| WO | WO-2006/115053 | A1 | | 11/2006 |

OTHER PUBLICATIONS

Notification of Reasons for Refusal in Japanese Patent Application No. 2012-017757, dated Nov. 4, 2015.

* cited by examiner

AIR CONDITIONING APPARATUS

CROSS-REFERENCE TO RELATED APPLICATIONS

The present application claims the benefit of priority of Japanese Patent Application No. 2012-017757, filed on Jan. 31, 2012, which is incorporated herein by reference.

BACKGROUND

Field of the Invention

The present invention relates to an air conditioning apparatus in which at least one outdoor unit and a plurality of indoor units are alternately connected by refrigerant pipes.

Related Art

Conventionally, an air conditioning apparatus has been proposed in which at least one outdoor unit and a plurality of indoor units are alternately connected by a plurality of refrigerant pipes. If the temperature of the outdoor heat exchanger becomes equal to or lower than 0 degrees C. while this air conditioning apparatus is performing a heating operation, there is a possibility that frost forms on the outdoor heat exchanger. If frost adheres to the outdoor heat exchanger, the heat exchange between the refrigerant and outside air is hindered by the frost, so that there is a possibility that the heat exchange efficiency at the outdoor heat exchanger is reduced. Therefore, when frost forms on the outdoor heat exchanger, it is necessary to perform a defrosting operation to remove the frost from the outdoor heat exchanger.

For example, in an air conditioning apparatus described in JP-A-2009-228928 (page 9, FIG. 1), one outdoor unit having a compressor, a four-way valve, an outdoor heat exchanger and an outdoor fan and two indoor units each having an indoor heat exchanger and an indoor fan are connected by a plurality of refrigerant pipes. When the defrosting operation is performed while the heating operation is being performed by this air conditioning apparatus, the rotations of the outdoor fan and the indoor fan are stopped, the compressor is temporarily stopped, the four-way valve is switched so that the state of the outdoor heat exchanger is changed from a state of functioning as an evaporator to a state of functioning as a condenser, and the compressor is started again. By causing the outdoor heat exchanger to function as a condenser, the high-temperature refrigerant discharged from the compressor flows into the outdoor heat exchanger to thaw the frost adhering to the outdoor heat exchanger. Thereby, the outdoor heat exchanger can be defrosted.

As the condition for the shift from the heating operation to the defrosting operation, the following condition is preset: a condition where it is considered that frost forms on the outdoor heat exchanger such as when the state in which the temperature of the heat exchanger is equal to or lower than 0 degrees C. continues for 10 minutes or longer while the air conditioning apparatus is performing the heating operation (hereinafter, referred to as defrosting operation start condition), and when the defrosting operation start condition is satisfied, a shift from the heating operation to the defrosting operation is made. As the condition for ending the defrosting operation, the following condition is preset: a condition where it is considered that the frost adhering to the outdoor heat exchanger is thawed such as when the temperature of the outdoor heat exchanger becomes equal to or higher than 5 degrees C. (hereinafter, referred to as defrosting operation end condition), and when the defrosting operation end condition is satisfied, the heating operation is resumed from the defrosting operation.

On the other hand, when the heating operation is being performed by the above-described air conditioning apparatus, there is a possibility that the refrigerant oil discharged from the compressor together with the refrigerant accumulates in the refrigerant circuit of the air conditioning apparatus, so that there is a possibility that the amount of refrigerant oil in the compressor is reduced to cause lubrication deficiency in the mechanical part of the compressor. Therefore, when the air conditioning apparatus is performing the heating operation, it is necessary to periodically perform an oil recovery operation to return the refrigerant oil to the compressor.

When the oil recovery operation is performed, the rotation of the indoor fan is stopped, and as when the defrosting operation is performed, the compressor is temporarily stopped, the four-way valve is switched so that the state of the outdoor heat exchanger is changed from the state of functioning as an evaporator to the state of functioning as a condenser, and the compressor is started again. By driving the compressor with the refrigerant circuit in such a state, a refrigerant of high wetness flows through the refrigerant circuit, so that the refrigerant oil remaining in the refrigerant circuit is sucked into the compressor to be returned into the compressor.

As the condition for the shift to the oil recovery operation, the following condition is preset: a condition where the refrigerant oil is discharged from the compressor and the amount of refrigerant oil in the compressor becomes equal to or lower than an amount that hinders the operation of the compressor such as every time the total operating time of the compressor becomes three hours (hereinafter, referred to as oil recovery operation start condition), and when the oil recovery operation start condition is satisfied, a shift from the heating operation to the oil recovery operation is made. As the condition for ending the oil recovery operation, the following condition is preset: a condition where it is considered that a wet refrigerant (a condition where fluid refrigerant is contained in gas refrigerant) is sucked in the compressor and the refrigerant oil remaining in the refrigerant circuit is sucked into the the compressor together with the wet refrigerant such as when the superheating degree of the refrigerant sucked into the compressor (hereinafter, referred to as sucking superheating degree) becomes equal to or lower than 0 degrees C. (hereinafter, referred to as oil recovery operation end condition), and when the oil recovery operation end condition is satisfied, the heating operation is resumed from the oil recovery operation.

SUMMARY

As described above, when the air conditioning apparatus is performing the heating operation, there are cases where the heating operation is stopped, switching is made so that the outdoor heat exchanger functions as a condenser and the defrosting operation and the oil recovery operation (hereinafter, referred to as reverse defrosting operation and reverse oil recovery operation) are performed, and generally, the defrosting operation start condition for the shift to the reverse defrosting operation and the oil recovery operation start condition for the shift to the reverse oil recovery operation are set to different conditions.

Consequently, there is a possibility that the defrosting operation start condition and the oil recovery operation start condition are intermittently satisfied such that the defrosting operation start condition is satisfied to make a shift from the heating operation to the reverse defrosting operation and immediately after the reverse defrosting operation is ended and the heating operation is resumed, the oil recovery operation start condition is satisfied to make a shift from the heating operation to the reverse oil recovery operation. If such a situation occurs, even though the reverse defrosting operation is ended and the heating operation is resumed, the heating operation is interrupted again by the shift to the reverse oil recovery operation, so that if the situation frequently occurs in which the defrosting operation start condition and the oil recovery operation start condition are intermittently satisfied, the heating operation is frequently interrupted, which can impair user comfort.

One or more embodiments of the present invention provides an air conditioning apparatus which prevents the reverse defrosting operation and the reverse oil recovery operation from being frequently executed to frequently interrupt the heating operation.

According to one or more embodiments of the present invention, an air-conditioning apparatus is provided with: at least one outdoor unit including a compressor; a flow path switching valve, an outdoor heat exchanger, outdoor heat exchanger temperature detecting means for detecting a temperature of the outdoor heat exchanger, and sucking superheating degree detecting means for detecting a sucking superheating degree as a superheating degree of a refrigerant sucked into the compressor; a plurality of indoor units having an indoor heat exchanger; and a refrigerant circuit in which the at least one outdoor unit and the indoor units are alternately connected by a plurality of refrigerant pipes. In this air conditioning apparatus, when the temperature of the outdoor heat exchanger detected by the outdoor heat exchanger temperature detecting means becomes equal to or higher than a predetermined temperature and the sucking superheating degree detected by the sucking superheating degree detecting means becomes equal to or lower than a predetermined temperature while a reverse defrosting operation to thaw frost forming on the outdoor heat exchanger by causing the outdoor heat exchanger to function as a condenser is being performed, the reverse defrosting operation is ended.

According to one or more embodiments of the present invention as described above, the air conditioning apparatus of the present invention has a reverse oil recovery operation to recover a refrigerant oil discharged from the compressor and remaining in the refrigerant circuit, into the compressor by causing the outdoor heat exchanger to function as a condenser every time a total operating time of the compressor becomes a predetermined time, and the air conditioning apparatus resets the total operating time when the reverse defrosting operation is ended.

According to one or more embodiments of the present invention as described above, since the state of the refrigerant circuit when the reverse defrosting operation is performed and the state of the refrigerant circuit when the reverse oil recovery operation is performed are the same, even if the temperature of the outdoor heat exchanger becomes equal to or higher than a predetermined temperature when the reverse defrosting operation is being performed, by continuing the reverse defrosting operation until the condition where it is considered that the refrigerant oil can be recovered is satisfied, that is, until the sucking superheating degree of the compressor becomes equal to or lower than a predetermined temperature, the refrigerant oil can also be recovered. Moreover, since the total operating time as the reverse oil recovery operation start condition is reset when the reverse defrosting operation is ended, the situation in which the defrosting operation start condition and the oil recovery operation start condition are intermittently satisfied can be prevented from frequency occurring to frequently interrupt the heating operation, so that user comfort is not impaired.

DETAILED DESCRIPTION

Hereinafter, an embodiment of the present invention will be described in detail based on the attached drawings. As the embodiment, an air conditioning apparatus will be described as an example in which two outdoor units and four indoor units are alternately connected by refrigerant pipes and a so-called simultaneous cooling and heating operation can be performed in which each indoor unit can selectively perform the cooling operation and the heating operation. The present invention is not limited to the embodiment described below and may be variously modified without departing from the gist of the present invention.

Embodiment

Figure 1:
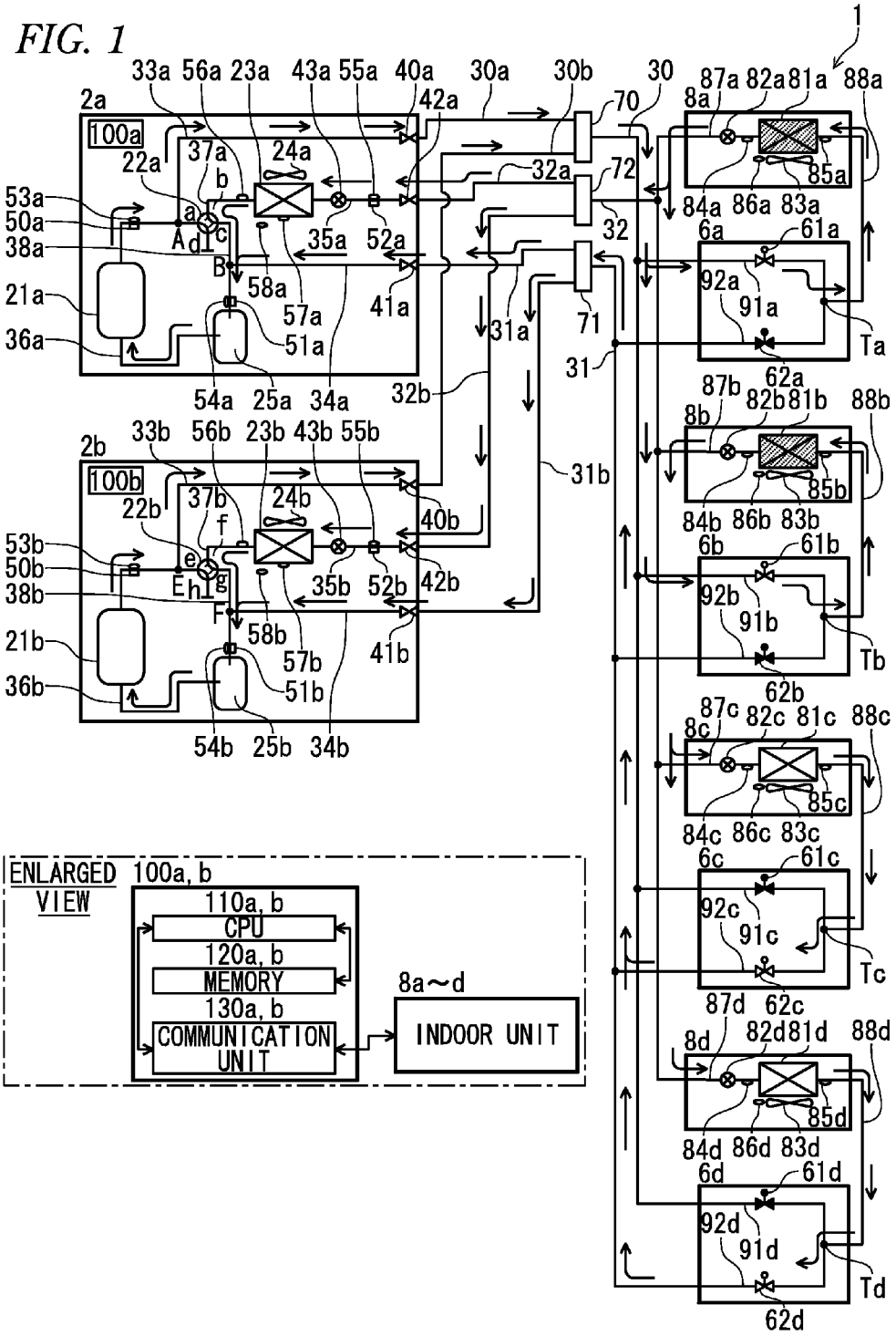
FIG. 1 is a refrigerant circuit diagram explaining the flow of the refrigerant when the heating dominant operation is performed in an embodiment of the present invention.

As shown in FIG. 1, an air conditioning apparatus 1 in the present embodiment is provided with two outdoor units 2*a* and 2*b*, four indoor units 8*a* to 8*d*, four switching units 6*a* to 6*d* and splitters 70, 71 and 72. The outdoor units 2*a* and 2*b*, the indoor units 8*a* to 8*d*, the switching units 6*a* to 6*d* and the splitters 70, 71 and 72 are alternately connected by a high pressure gas pipe 30, split high pressure gas pipes 30*a* and 30*b*, a low pressure gas pipe 31, split low pressure gas pipes 31*a* and 31*b*, a fluid pipe 32 and split fluid pipes 32*a* and 32*b* to thereby form a refrigerant circuit of the air conditioning apparatus 1.

In this air conditioning apparatus 1, by opening and closing or switching various valves provided in the outdoor units 2*a* and 2*b* and the switching units 6*a* to 6*d*, various operations can be performed such as the heating operation (all the indoor units perform the heating operation), a heating dominant operation (a case where the overall ability required by the indoor units performing the heating operation is higher than that required by the indoor units performing the cooling operation), the cooling operation (all the indoor units perform the cooling operation) and a cooling dominant operation (a case where the overall ability required by the indoor units performing the cooling operation is higher than that required by the indoor units performing the heating operation).

FIG. 1 shows a refrigerant circuit when of these operations, the heating dominant operation is being performed. First, using FIG. 1, the structures of the outdoor units 2*a* and 2*b* will be described. Since the structures of the outdoor units 2*a* and 2*b* are all the same, in the description given below, only the structure of the indoor unit 2*a* will be described, and a detailed description of the indoor unit 2*b* is omitted.

As shown in FIG. 1, the indoor unit 2*a* is provided with a compressor 21*a*, a four-way valve 22*a* as the flow path switching valve, an outdoor heat exchanger 23*a*, an outdoor fan 24*a*, an accumulator 25*a*, an outdoor unit high pressure gas pipe 33*a*, an outdoor unit low pressure gas pipe 34*a*, an outdoor unit fluid pipe 35*a*, refrigerant pipes 36*a*, 37*a* and 38*a*, closing valves 40*a*, 41*a* and 42*a* and an outdoor expansion valve 43*a*.

The compressor 21*a* is an ability variable compressor the operating capacity of which can be varied by being driven by a non-illustrated motor the number of rotations of which is controlled by an inverter. The discharge side of the compressor 21*a* is connected to the closing valve 40*a* by the outdoor unit high pressure gas pipe 33*a*. The sucking side of the compressor 21*a* is connected to the outflow side of the accumulator 25*a* by the refrigerant pipe 36*a*. The inflow side of the accumulator 25*a* is connected to the closing valve 41*a* by the outdoor unit low pressure gas pipe 34*a*.

The four-way valve 22*a* is a valve for switching the direction of the flow of the refrigerant, and has four ports a, b, c and d. To the port a, a refrigerant pipe connected to the outdoor unit high pressure gas pipe 33*a* at a connection point A is connected. The port b and the outdoor heat exchanger 23*a* are connected by the refrigerant pipe 37*a*. The refrigerant pipe 38*a* connected to the port c is connected to the outdoor unit low pressure gas pipe 34*a* at a connection point B. The port d is sealed.

The outdoor heat exchanger 23*a* performs heat exchange between the refrigerant and the outside air taken into the indoor unit 2*a* by the outdoor fan 24*a* described later. One end of the outdoor heat exchanger 23*a* is connected to the port b of the four-way valve 22*a* by the refrigerant pipe 37*a* as mentioned above, and the other end thereof is connected to one port of the outdoor expansion valve 43*a* by a refrigerant pipe. The other port of the outdoor expansion valve 43*a* is connected to the closing valve 42*a* by the outdoor unit fluid pipe 35*a*. The outdoor heat exchanger 23*a* functions as a condenser when the air conditioning apparatus 1 performs the cooling/cooling dominant operation, and functions as an evaporator when the air conditioning apparatus 1 performs the heating/heating dominant operation.

The outdoor fan 24*a* is a propeller fan made of a resin material and disposed in the vicinity of the outdoor heat exchanger 23*a*, and is rotated by a non-illustrated fan motor to thereby take outside air into the indoor unit 2*a*. After heat exchange between the refrigerant and the outside air is performed at the outdoor heat exchanger 23*a*, the heat-exchanged outside air is discharged to the outside of the indoor unit 2*a*.

The accumulator 25*a* has the inflow side thereof connected to the outdoor unit low pressure gas pipe 34*a* and has the outflow side thereof connected to the sucking side of the compressor 21*a* by the refrigerant pipe 36*a*. The accumulator 25*a* separates the inflowing refrigerant into a gas refrigerant and a fluid refrigerant, and allows only the gas refrigerant to be sucked into the compressor 21*a*.

In addition to the above-described structure, various sensors are provided in the outdoor unit 2*a*. As shown in FIG. 1, a high pressure sensor 50*a* that detects the discharge pressure of the refrigerant discharged from the compressor 21*a* and a discharge temperature sensor 53*a* that detects the temperature of the refrigerant discharged from the compressor 21*a* are provided between the discharge side of the compressor 21*a* and the connection point A on the outdoor unit high pressure gas pipe 33*a*. A low pressure sensor 51*a* that detects the sucking pressure of the refrigerant sucked into the compressor 21*a* and a sucking temperature sensor 54*a* that detects the temperature of the refrigerant sucked into the compressor 21*a* are provided between the connection point B and the inflow side of the accumulator 25*a* on the outdoor unit low pressure gas pipe 34*a*. An intermediate pressure sensor 52*a* that detects the pressure of the refrigerant flowing through the outdoor unit fluid pipe 35*a* and a refrigerant temperature sensor 55*a* that detects the temperature of the refrigerant flowing through the outdoor unit fluid pipe 35*a* are provided between the outdoor expansion valve 43*a* and the closing valve 42*a* on the outdoor unit fluid pipe 35*a*.

On the refrigerant pipe 37*a*, a refrigerant temperature sensor 56*a* is provided that detects the temperature of the refrigerant flowing out from the outdoor heat exchanger 23*a* or flowing into the outdoor heat exchanger 23*a*. In the outdoor heat exchanger 23*a*, an outdoor heat exchanger temperature sensor 57*a* as the outdoor heat exchanger temperature detecting means for detecting the temperature of the outdoor heat exchanger 23*a* is provided. In the vicinity of a non-illustrated outside air inlet of the outdoor unit 2*a*, an outside air temperature sensor 58*a* is provided that detects the temperature of the outside air flowing into the outdoor unit 2*a*, that is, the outside air temperature.

The outdoor unit 2*a* is provided with a controller 100*a*. The controller 100*a* is mounted on a control board accommodated in a non-illustrated electric component box of the outdoor unit 2*a*, and is provided with a CPU 110*a*, a memory 120*a* and a communication unit 130*a*. The CPU 110*a* acquires the detection signals from the above-described sensors of the outdoor unit 2*a*, and acquires the control signals transmitted from the indoor units 8*a* to 8*d* through the communication unit 130*a*. The CPU 110*a* performs various control operations related to the operations of the outdoor unit 2*a* such as the rotation control of the compressor 21*a* and the outdoor fan 24*a*, the switching control of the four-way valve 22*a* and the opening control of the outdoor expansion valve 43*a* based on the acquired detection signals and control signals.

The memory 120*a* is formed of a ROM or a RAM, and stores the control programs of the outdoor unit 2*a* and the detection values corresponding to the detection signals from the sensors. The communication unit 130*a* is an interface mediating communication between the outdoor unit 2*a* and the indoor units 8*a* to 8*d*.

While the structure of the outdoor unit 2*a* has been described, the structure of the outdoor unit 2*b* is the same as that of the outdoor unit 2*a*, and the components denoted by reference designations where the letters following the numbers denoting the components (devices and members) of the outdoor unit 2*a* are changed from a to b are the components of the outdoor unit 2*b* corresponding to the components of the outdoor unit 2*a*. For the ports of the four-way valves and the connection points of the refrigerant pipes, reference designations are different between the indoor unit 2*a* and the indoor unit 2*b*. The ports of a four-way valve 22*b* of the outdoor unit 2*b* corresponding to the ports a, b, c and d of the four-way valve 22*a* of the outdoor unit 2*a* are ports e, f, g and h, respectively. The connection points in the outdoor unit 2*b* corresponding to the connection points A, B, C and D in the outdoor unit 2*a* are connection points E, F, G and H, respectively.

Next, the structures of the four indoor units 8*a* to 8*d* will be described by using FIG. 1. Since the structures of the indoor units 8*a* to 8*d* are all the same, in the description given below, only the structure of the indoor unit 8*a* will be described, and descriptions of the other indoor units 8*b* to 8*d* are omitted.

The indoor unit 8*a* is provided with an indoor heat exchanger 81*a*, an indoor expansion valve 82*a*, an indoor fan 83*a* and refrigerant pipes 87*a* and 88*a*. The indoor heat exchanger 81*a* has one end thereof connected to one port of the indoor expansion valve 82*a* by a refrigerant pipe, and has the other end thereof connected to the later-described switching unit 6*a* by the refrigerant pipe 88*a*. The indoor heat exchanger 81*a* functions as an evaporator when the indoor unit 8*a* performs the cooling operation, and functions as a condenser when the indoor unit 8*a* performs the heating operation.

The indoor expansion valve 82*a* has one port thereof connected to the indoor heat exchanger 81*a* by a refrigerant pipe as described above, and has the other port thereof connected to the fluid pipe 32 by the refrigerant pipe 87*a*. The indoor expansion valve 82*a* has the opening thereof adjusted according to the required cooling ability when it functions as an evaporator, and has the opening thereof adjusted according to the required heating ability when it functions as a condenser.

The indoor fan 83*a* is a cross flow fan made of a resin material, and is rotated by a non-illustrated fan motor to thereby take indoor air into the indoor unit 8*a*. After heat exchange between the refrigerant and the indoor air is performed at the indoor heat exchanger 81*a*, the heat-exchanged air is supplied into the room.

In addition to the above-described structure, the indoor unit 8*a* is provided with various sensors. On the refrigerant pipe on the indoor expansion valve 82*a* side of the indoor heat exchanger 81*a*, a refrigerant temperature sensor 84*a* is provided that detects the temperature of the refrigerant flowing into the indoor heat exchanger 81*a* or flowing out from the indoor heat exchanger 81*a*. On the refrigerant pipe 88*a*, a refrigerant temperature sensor 85*a* is provided that detects the temperature of the refrigerant flowing into the indoor heat exchanger 81*a* or flowing out from the indoor heat exchanger 81*a*. In the vicinity of a non-illustrated indoor air inlet of the indoor unit 8*a*, a room temperature sensor 86*a* is provided that detects the temperature of the indoor air flowing into the indoor unit 8*a*, that is, the room temperature.

Although not shown, the indoor units 8*a* to 8*d* each have a controller. The controllers of the indoor units 8*a* to 8*d* acquire the detection signals from the sensors of the indoor units 8*a* to 8*d*, and acquire an operation instruction signal set by the user with a non-illustrated remote controller of the air conditioning apparatus 1. The controllers of the indoor units 8*a* to 8*d* perform operation control of the indoor units 8*a* to 8*d* based on the acquired detection signals and operation instruction signal, and transmit signals containing the operation abilities required by the indoor units 8*a* to 8*d* to the outdoor units 2*a* and 2*b*. Moreover, the controllers of the indoor units 8*a* to 8*d* open and close later-described discharge valves 61*a* to 61*d* and inlet valves 62*a* to 62*d* of the corresponding switching units 6*a* to 6*d* according to the operation mode (the cooling operation/the heating operation) information contained in the operation instruction signal.

While the structure of the indoor unit 8*a* has been described, the structures of the indoor units 8*b* to 8*d* are the same as that of the indoor unit 8*a*, and the components denoted by reference designations where the letters following the numbers denoting the components (devices and members) of the indoor unit 8*a* are changed from a to b, c and d are the components of the indoor units 8*b* to 8*d* corresponding to the components of the indoor unit 8*a*.

Next, the structures of the four switching units 6*a* to 6*d* will be described by using FIG. 1. The air conditioning apparatus 1 is provided with the four switching units 6*a* to 6*d* corresponding to the four indoor units 8*a* to 8*d*. Since the structures of the switching units 6*a* to 6*d* are all the same, in the description given below, only the structure of the switching unit 6*a* will be described, and descriptions of the other switching units 6*b* to 6*d* are omitted.

The switching unit 6*a* is provided with the discharge valve 61*a*, the inlet valve 62*a*, a first flow dividing pipe 91*a* and a second flow dividing pipe 92*a*. One end of the first flow dividing pipe 91*a* is connected to the high pressure gas pipe 30, and one end of the second flow dividing pipe 92*a* is connected to the low pressure gas pipe 31. The other end of the first flow dividing pipe 91*a* and the other end of the second flow dividing pipe 92*a* are connected to the refrigerant pipe 88*a* at a connection point Ta.

The first flow dividing pipe 91*a* incorporates the discharge valve 61*a*, and the second flow dividing pipe 92*a* incorporates the inlet valve 62*a*. When the discharge valve 61*a* is opened and the inlet valve 62*a* is closed, the indoor heat exchanger 81*a* of the indoor unit 8*a* corresponding to the switching unit 6*a* is connected to the discharge side (the side of the high pressure gas pipe 30) of the compressor 21*a* through the refrigerant pipe 88*a*, so that the indoor heat exchanger 81*a* functions as a condenser. When the inlet valve 62*a* is opened and the discharge valve 61*a* is closed, the indoor heat exchanger 81*a* of the indoor unit 8*a* corresponding to the switching unit 6*a* is connected to the sucking side (the side of the low pressure gas pipe 31) of the compressor 21*a* through the refrigerant pipe 88*a*, so that the indoor heat exchanger 81*a* functions as an evaporator.

While the switching unit 6*a* has been described, the structures of the switching units 6*b* to 6*d* are the same as that of the switching unit 6*a*, and the components denoted by reference designations where the letters following the numbers denoting the components (devices and members) of the switching unit 6*a* are changed from a to b, c and d are the components of the switching units 6*b* to 6*d* corresponding to the components of the switching unit 6*a*.

Next, the connection condition of the above-described outdoor units 2*a* and 2*b*, indoor units 8*a* to 8*d*, switching units 6*a* to 6*d*, high pressure gas pipe 30, split high pressure gas pipes 30*a* and 30*b*, low pressure gas pipe 31, split low pressure gas pipes 31*a* and 31*b*, fluid pipe 32, split fluid pipes 32*a* and 32*b* and splitters 70, 71 and 72 will be described by using FIG. 1. To the closing valves 40*a* and 40*b* of the outdoor units 2*a* and 2*b*, one ends of the split high pressure gas pipes 30*a* and 30*b* are connected, respectively, and the other ends of the split high pressure gas pipes 30*a* and 30*b* are both connected to the splitter 70. To the splitter 70, one end of the high pressure gas pipe 30 is connected, and the other end of the high pressure gas pipe 30 branches off to be connected to the first flow dividing pipes 91*a* to 91*d* of the switching units 6*a* to 6*d*.

To the closing valves 41*a* and 41*b* of the outdoor units 2*a* and 2*b*, one ends of the split low pressure gas pipes 31*a* and 31*b* are connected, respectively, and the other ends of the split low pressure gas pipes 31*a* and 31*b* are both connected to the splitter 71. To the splitter 71, one end of the low pressure gas pipe 31 is connected, and the other end of the low pressure gas pipe 31 branches off to be connected to the second flow dividing pipes 92*a* to 92*d* of the switching units 6*a* to 6*d*.

To the closing valves 42*a* and 42*b* of the outdoor units 2*a* and 2*b*, one ends of the split fluid pipes 32*a* and 32*b* are connected, respectively, and the other ends of the split fluid pipes 32*a* and 32*b* are both connected to the splitter 72. To the splitter 72, one end of the fluid pipe 32 is connected, and the other end of the fluid pipe 32 branches off to be connected to the refrigerant pipes 87*a* to 87*d* of the indoor units 8*a* to 8*d*.

To the indoor heat exchangers 81*a* to 81*d* of the indoor units 8*a* to 8*d*, one ends of the refrigerant pipes 88*a* to 88*d* are connected, and the other ends of the refrigerant pipes 88*a* to 88*d* are connected to the first flow dividing pipes 91*a* to 91*d* and the second flow dividing pipes 92*a* to 92*d* of the switching units 6*a* to 6*d* corresponding to the indoor units 8*a* to 8*d* at the connection points Ta to Td.

The above-described connections constitute the refrigerant circuit of the air conditioning apparatus 1, and a refrigeration cycle is established by flowing the refrigerant in the refrigerant circuit.

Next, the operation of the air conditioning apparatus 1 in the present embodiment will be described by using FIG. 1. In the description given below, the heat exchangers provided in the outdoor units 2*a* and 2*b* and the indoor units 8*a* to 8*d* are hatched when they function as condensers, and they are shown without hatched when they function as evaporators. For the open/closed condition of the discharge valves 61*a* to 61*d* and the inlet valves 62*a* to 62*d* provided in the switching units 6*a* to 6*d*, the closed valves are blackened, and the opened valves are shown without blackened. The arrows indicate the flow of the refrigerant.

When of the four indoor units 8*a* to 8*d*, the two indoor units 8*a* and 8*b* perform the heating operation and the other indoor units 8*c* and 8*d* perform the cooling operation as shown in FIG. 1, in a case where the overall ability required by the two indoor units 8*a* and 8*b* performing the heating operation is higher than the overall ability required by the indoor units 8*c* and 8*d* performing the cooling operation, the air conditioning apparatus 1 performs the heating dominant operation. In the description given below, a case will be described where the overall operating ability required by the indoor units 8*a* to 8*d* is high and all the outdoor units 2*a* and 2*b* are operated.

Specifically, the CPU 110*a* of the outdoor unit 2*a* switches the four-way valve 22*a* so that the port a and the port d communicate and that the port b and the port c communicate (the condition shown by the solid line in FIG. 1). Consequently, the refrigerant pipe 37*a* is connected to the outdoor unit low pressure gas pipe 34*a* through the refrigerant pipe 38*a* to connect the outdoor heat exchanger 23*a* to the sucking side of the compressor 21*a*, so that the outdoor heat exchanger 23*a* functions as an evaporator. Likewise, the CPU 110*b* of the outdoor unit 2*b* switches the four-way valve 22*b* so that the port e and the port h communicate and that the port f and the port g communicate (the condition shown by the solid line in FIG. 1), so that the outdoor heat exchanger 23*b* functions as an evaporator.

The controllers of the indoor units 8*a* and 8*b* performing the heating operation open the discharge valves 61*a* and 61*b* of the corresponding switching units 6*a* and 6*b* so that the refrigerant flows through the first flow dividing pipes 91*a* and 91*b*, and close the inlet valves 62*a* and 62*b* to prevent the refrigerant from flowing through the second flow dividing pipes 92*a* and 92*b*. Consequently, the indoor heat exchangers 81*a* and 81*b* of the indoor units 8*a* and 8*b* function as condensers.

On the other hand, the controllers of the indoor units 8*c* and 8*b* performing the cooling operation close the discharge valves 61*c* and 61*d* of the corresponding switching units 6*c* and 6*d* to prevent the refrigerant from flowing through the first flow dividing pipes 91*c* and 91*d*, and open the inlet valves 62*c* and 62*d* so that the refrigerant flows through the second flow dividing pipes 92*c* and 92*d*. Consequently, the indoor heat exchangers 81*c* and 81*d* of the indoor units 8*c* and 8*d* function as evaporators.

The high pressure refrigerants discharged from the compressors 21*a* and 21*b* flow through the outdoor unit high pressure gas pipes 33*a* and 33*b*, and flow into the split high pressure gas pipes 30*a* and 30*b* by way of the closing valves 40*a* and 40*b*. The refrigerants flowing into the split high pressure gas pipes 30*a* and 30*b* join together at the splitter 70, flow into the high pressure gas pipe 30, and is split to flow into the switching units 6*a* and 6*b* from the high pressure gas pipe 30. The refrigerants having flown into the switching units 6*a* and 6*b* flow through the first flow dividing pipes 91*a* and 91*b* incorporating the discharge valves 61*a* and 61*b* which are opened, flow out from the switching units 6*a* and 6*b* by way of the connection points Ta and Tb, and flow through the refrigerant pipes 88*a* and 88*b* to flow into the indoor units 8*a* and 8*b*.

The refrigerants having flown into the indoor units 8*a* and 8*b* flow into the indoor heat exchangers 81*a* and 81*b*, and undergo heat exchange with indoor air to be condensed. Thereby, the rooms where the indoor units 8*a* and 8*b* are placed are heated. The refrigerants having flown out from the indoor heat exchangers 81*a* and 81*b* pass through the indoor expansion valves 82*a* and 82*b* incorporated in the refrigerant pipes 87*a* and 87*b* to be decompressed into intermediate pressure refrigerants. The controllers of the indoor units 8*a* and 8*b* obtain the refrigerant supercooling degree at the indoor heat exchangers 81*a* and 81*b* as condensers from the refrigerant temperatures acquired from the refrigerant temperature sensors 84*a* and 84*b* and the high pressure saturation temperatures (calculated from the discharge pressures acquired from the high pressure sensors 50*a* and 50*b* by the CPUs 110*a* and 110*b*) received from the outdoor units 2*a* and 2*b*, and according to this, determine the openings of the indoor expansion valves 82*a* and 82*b*.

The refrigerants having passed through the indoor expansion valves 82*a* and 82*b*, flown through the refrigerant pipes 87*a* and 87*b* and flown out from the indoor units 8*a* and 8*b* flow into the fluid pipe 32. The refrigerant having flown into the fluid pipe 32 partly flows into the splitter 72, and the remainder flows through the fluid pipe 32 to flow into the indoor units 8*c* and 8*d*. The refrigerant having flown into the splitter 72 is split to flow into the split fluid pipes 32*a* and 32*b*, and flows into the outdoor units 2*a* and 2*b* by way of the closing valves 42*a* and 42*b*.

The refrigerants having flown into the outdoor units 2*a* and 2*b* are decompressed into low pressure refrigerants when passing through the outdoor expansion valves 43*a* and 43*b*, flow into the outdoor heat exchangers 23*a* and 23*b*, and undergo heat exchange with outdoor air to be evaporated. The refrigerants having flown out from the outdoor heat exchangers 23*a* and 23*b* pass through the four-way valves 22*a* and 22*b* to flow into the refrigerant pipes 38*a* and 38*b*, and flow into the outdoor unit low pressure gas pipes 34*a* and 34*b* from the connection points B and F. The refrigerants having flown into the outdoor unit low pressure gas pipes 34*a* and 34*b* flow through the refrigerant pipes 36*a* and 36*b* by way of the accumulators 25*a* and 25*b*, and are sucked into the compressors 21*a* and 21*b* to be compressed again.

On the other hand, the intermediate pressure refrigerants having flown out from the indoor units 8*a* and 8*b*, flown through the fluid pipe 32 and flown into the indoor units 8*c* and 8*d* pass through the indoor expansion valves 82*c* and 82*d* incorporated in the refrigerant pipes 87*c* and 87*d* to be decompressed into low pressure refrigerants, and flow into the indoor heat exchangers 81*c* and 81*d*. The refrigerants having flown into the indoor heat exchangers 81*c* and 81*d* undergo heat exchange with indoor air to be evaporated. Thereby, the rooms where the indoor units 8*c* and 8*d* are placed are cooled. The controllers of the indoor units 8*c* and 8*d* obtain the refrigerant superheating degree at the indoor heat exchangers 81*c* and 81*d* as evaporators from the refrigerant temperatures detected by the refrigerant temperature sensors 84*c* and 84*d* and the refrigerant temperatures detected by the refrigerant temperature sensors 85*c* and 85*d*, and according to this, determine the openings of the indoor expansion valves 82*c* and 82*d*.

The refrigerants having flown out from the indoor heat exchangers 81*c* and 81*d* flow through the refrigerant pipes 88*c* and 88*d* to flow into the switching units 6*c* and 6*d*, and by way of the connection points Tc and Td, flow through the second flow dividing pipes 92*c* and 92*d* incorporating the inlet valves 62*c* and 62*d* which are opened. Then, the refrigerants flow out from the switching units 6*c* and 6*d* to flow into the low pressure gas pipe 31.

The refrigerant having flown into the low pressure gas pipe 31 flows into the splitter 71, and is split to flow from the splitter 71 into the split low pressure gas pipes 31*a* and 31*b*. The refrigerants having flown through the split low pressure gas pipes 31*a* and 31*b* and flown into the outdoor units 2*a* and 2*b* flow from the outdoor unit low pressure gas pipes 34*a* and 34*b* through the refrigerant pipes 36*a* and 36*b* by way of the connection points B and F and the accumulators 25*a* and 25*b*, and are sucked into the compressors 21*a* and 21*b* to be compressed again.

Figure 2:
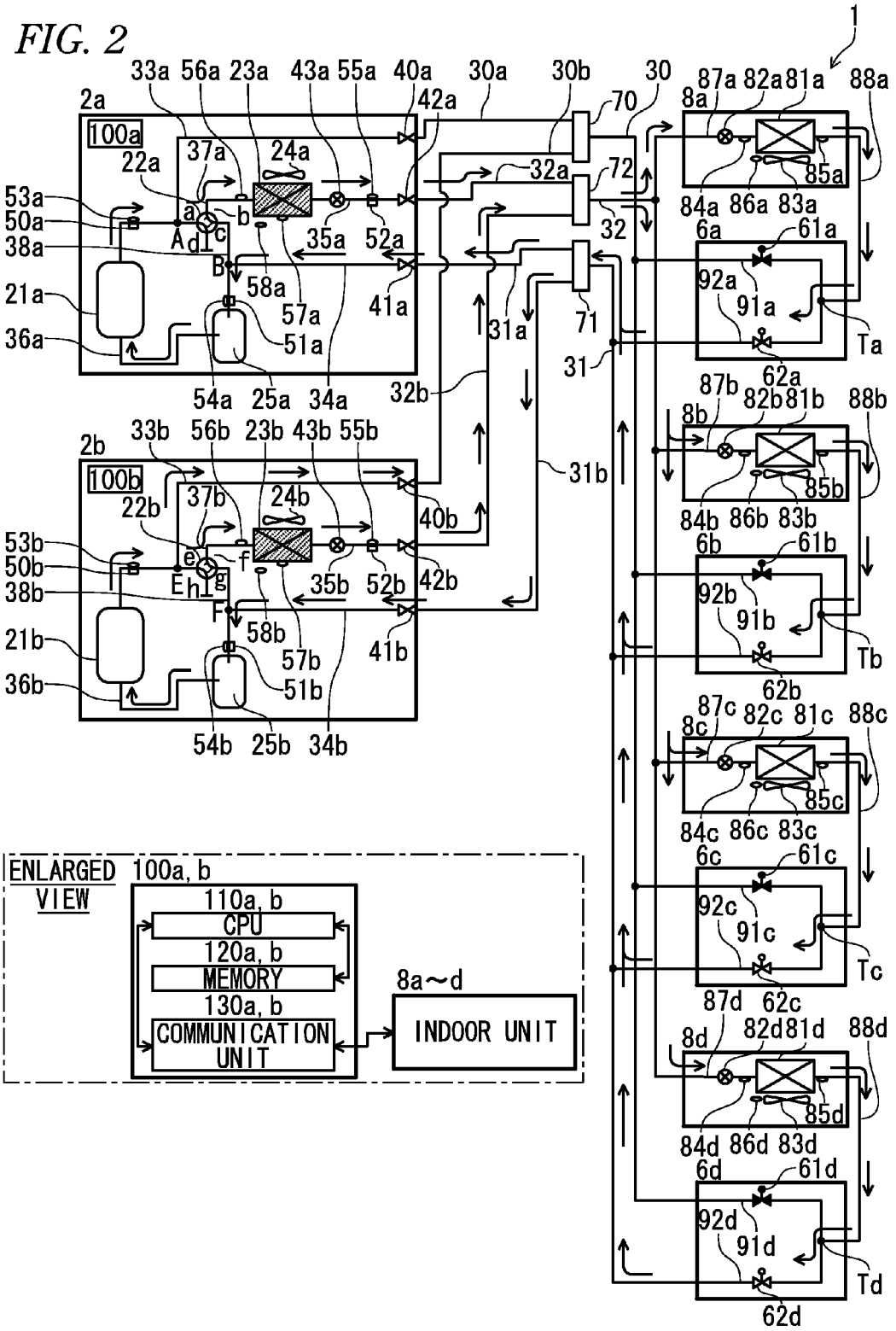
FIG. 2 is a refrigerant circuit diagram explaining the flow of the refrigerant when the defrosting operation is performed in the embodiment of the present invention.
Figure 3:
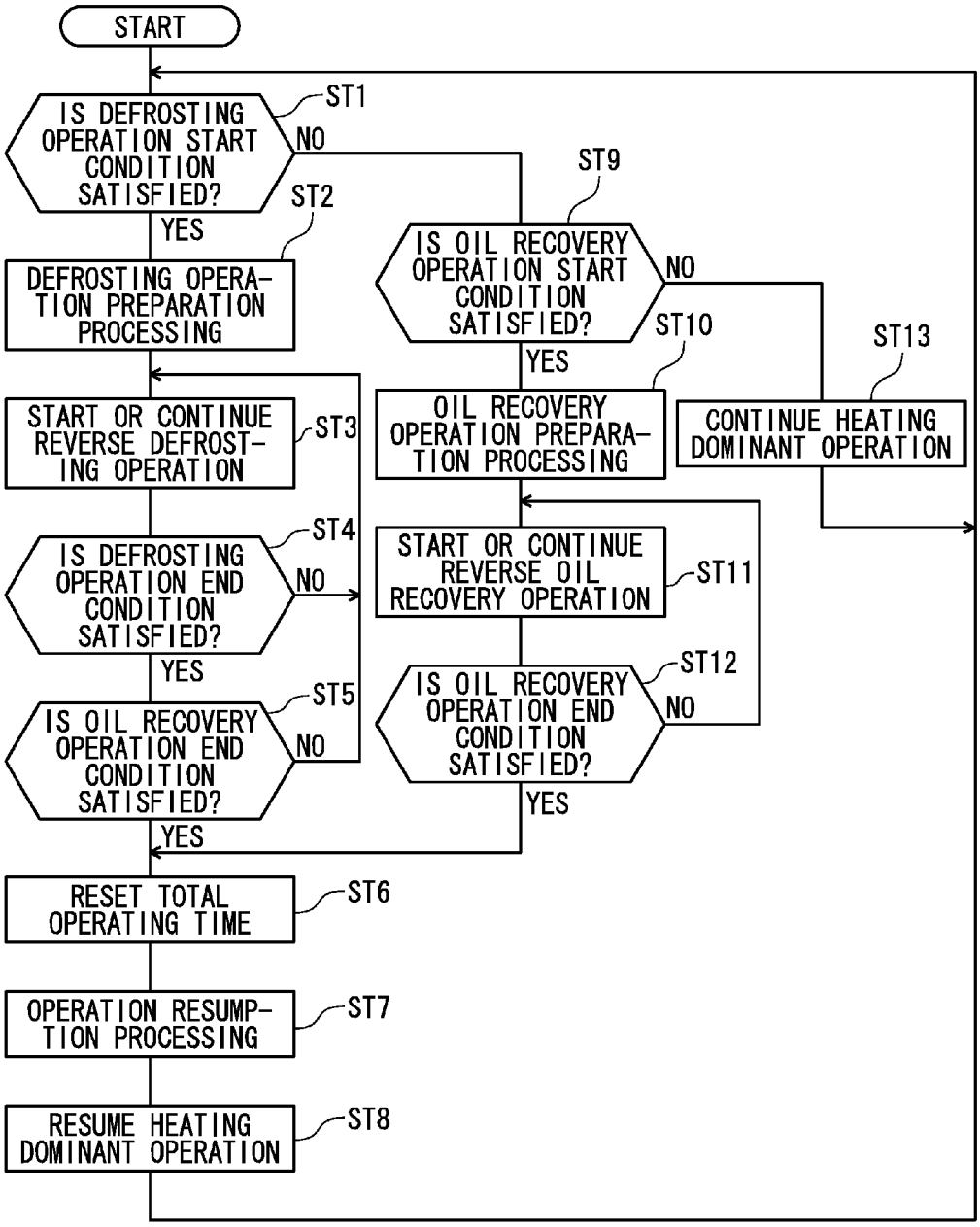
FIG. 3 is a flowchart explaining the processing at an outdoor unit in the embodiment of the present invention.

Next, control when the reverse defrosting operation and the reverse oil recovery operation in the air conditioning apparatus 1 of the present invention are performed will be described by using FIGS. 1 to 3. FIG. 2 is a refrigerant circuit diagram when the air conditioning apparatus 1 performs the reverse defrosting operation and the reverse oil recovery operation. FIG. 3 shows the flow of the processing when the air conditioning apparatus 1 performs the reverse defrosting operation and the reverse oil recovery operation. In FIG. 3, ST represents a step, and the number following this represents a step number. FIG. 3 mainly explains the processing related to the present invention, and descriptions are omitted of the flows of general processing related to air-conditioning operations such as the control of the refrigerant circuit according to operation conditions such as the set temperature and the air amount specified by the user.

In the description given above, the flow of the processing will be described with the following case as an example: When the air conditioning apparatus 1 is performing the heating dominant operation with the refrigerant circuit shown in FIG. 1, in at least one of the outdoor units 2*a* and 2*b*, the defrosting operation start condition or the oil recovery operation start condition is satisfied to make a shift to the reverse defrosting operation or the reverse oil recovery operation and after the reverse defrosting operation or the reverse oil recovery operation is ended, the heating dominant operation is resumed. Moreover, description will be given on the assumption that the outdoor unit 2*a* is the main unit and the CPU 110*a* of the outdoor unit 2*a* performs the processing shown in FIG. 3.

In addition to the above-described heating, heating dominant, cooling and cooling dominant operations, the air conditioning apparatus 1 is capable of performing the reverse defrosting operation performed to remove frost forming on the outdoor heat exchangers 23*a* and 23*b* and the reverse oil recovery operation performed to recover into the compressors 21*a* and 21*b* the refrigerant oil discharged from the compressors 21*a* and 21*b* together with the refrigerant.

When the air conditioning apparatus 1 is performing the heating dominant operation, the CPU 110*a* determines whether or not the defrosting operation start condition is satisfied in the outdoor unit 2*a* or the outdoor unit 2*b* (ST1). The CPU 110*a* determines whether or not the defrosting operation start condition is satisfied in the outdoor unit 2*a* or the outdoor unit 2*b* (ST2). The CPU 110*a* periodically acquires the temperature of the outdoor heat exchanger 23*a* detected by the outdoor heat exchanger temperature sensor 57*a* and stores it in the memory 120*a*, and periodically acquires through the communication unit 130*a* the temperature of the outdoor heat exchanger 23*b* acquired from the outdoor heat exchanger temperature sensor 57*b* by the CPU 110*b* and stores it in the memory 120*a*. The defrosting operation start condition is whether or not the time for which the temperature of either the outdoor heat exchanger 23*a* or the outdoor heat exchanger 23*b* is equal to or lower than 0 degrees C. is equal to or longer than a predetermined time, for example, equal to or longer than 10 minutes. The predetermined time is previously obtained through a test or the like and determined, and is a time in which frost formation is considered to occur on the outdoor heat exchanger 23*a* and the outdoor heat exchanger 23*b*.

At ST1, when the defrosting operation start condition is not satisfied (ST1-No), the CPU 110*a* determines whether or not the oil recovery operation start condition is satisfied in the outdoor unit 2*a* or the outdoor unit 2*b* (ST9). The CPU 110*a* totalizes the operating time of the compressor 21*a* of the outdoor unit 2*a* and stores it in the memory 120*a*, and periodically acquires through the communication unit 130*a* the operating time of the compressor 21*b* of the outdoor unit 2*b* totalized by the CPU 110*b* and stores it in the memory 120*a*. The oil recovery operation start condition is whether or not the total operating time of either the compressor 21*a* or the compressor 21*b* exceeds a predetermined time, for example, three hours. The total operating time is either the total operating time from the start of the compressor or the total operating time of the compressor from when the total operating time is reset. The predetermined time of the total operating time is previously obtained through a test or the like and determined, and by executing the reverse oil recovery operation every predetermined time, the refrigerant oil is never decreased to the amount that can hinder the operations of the compressors 21*a* and 21*b* and the operations of the compressors 21*a* and 21*b* can be continued without a problem.

When the oil recovery operation start condition is not satisfied in the outdoor unit 2*a* or the outdoor unit 2*b* (ST9-No), the CPU 110*a* continues the currently performed heating dominant operation (ST13), and returns the process to ST1. When the oil recovery operation start condition is satisfied in the outdoor unit 2*a* or the outdoor unit 2*b* (ST9-Yes), the CPU 110*a* starts oil recovery operation preparation processing (ST10). Specifically, the CPU 110*a* stops the compressor 21*a*, and as shown in FIG. 2, switches the four-way valve 22*a* so that the port a and the port b communicate and that the port c and the port d communicate (the condition shown by the solid line in FIG. 2) in order that the outdoor heat exchanger 23*a* functions as a condenser. Then, the CPU 110*a* counts the time from the start of the oil recovery operation preparation processing, and waits until a predetermined time (for example, three minutes) elapses from the start of the oil recovery operation preparation processing. This predetermined time is a time necessary for the high pressure side and the low pressure side of the refrigerant circuit of the air conditioning apparatus 1 to be equalized, and is previously obtained through a test or the like and stored in the memory 120*a*.

On the other hand, the CPU 110*a* transmits an oil recovery operation preparation processing signal to the outdoor unit 2*b* and the indoor units 8*a* to 8*d* through the communication unit 130*a*. The CPU 110*b* having received the oil recovery operation preparation processing signal through the communication unit 130*b* stops the compressor 21*b*, and as shown in FIG. 2, switches the four-way valve 22*b* so that the port e and the port f communicate and that the port g and the port h communicate (the condition shown by the solid line in FIG. 2) in order that the outdoor heat exchanger 23*b* functions as a condenser. Then, the CPU 110*b* waits for an instruction from the CPU 110*a* of the outdoor unit 2*a*.

The controllers of the indoor units 8*a* to 8*d* having received the oil recovery operation preparation processing signal from the outdoor unit 2*a* fully close the indoor expansion valves 82*a* to 82*d* to equalize the high pressure side and the low pressure side of the refrigerant circuit, and stop the indoor fans 83*a* to 83*d*. Moreover, the controllers of the indoor units 8*a* and 8*b* performing the heating operation close the discharge valves 61*a* and 61*b* of the corresponding switching units 6*a* and 6*b* to prevent the refrigerant from flowing through the first flow dividing pipes 91*a* and 91*b*, and open the inlet valves 62*a* and 62*b* so that the refrigerant flows through the second flow dividing pipes 92*a* and 92*b* in order that the indoor heat exchangers 81*a* and 81*b* of the indoor units 8*a* and 8*b* function as evaporators. On the other hand, for the indoor units 8*c* and 8*d* performing the cooling operation, since the indoor heat exchangers 81*c* and 81*d* are in a state of functioning as evaporators, the condition of the switching units 6*c* and 6*d* is not changed.

The controllers of the indoor units 8*a* to 8*d* having performed the above-described processing waits for an instruction from the outdoor unit 2*a*.

The CPU 110*a* having finished the processing of ST10 starts the reverse oil recovery operation (ST11). Specifically, the CPU 110*a* starts the compressor 21*a* and the outdoor fan 24*a* with a predetermined number of rotations. Moreover, the CPU 110*a* transmits a reverse oil recovery operation start signal to the outdoor unit 2*b* and the indoor units 8*a* to 8*d* through the communication unit 130*a*. The CPU 110*b* having received the reverse oil recovery operation start signal through the communication unit 130*b* starts the compressor 21*b* and the outdoor fan 24*b* with a predetermined number of rotations. The controllers of the indoor units 8*a* to 8*d* having received the reverse oil recovery operation start signal from the outdoor unit 2*a* set the openings of the indoor expansion valves 82*a* to 82*d* to a predetermined one.

The CPU 110*a* having started the reverse oil recovery operation at ST11 determines whether an oil recovery operation end condition is satisfied or not (ST12). When the reverse oil recovery operation is being performed, the CPU 110*a* periodically acquires the sucking pressure detected by the low pressure sensor 51*a* and the sucking temperature detected by the sucking temperature sensor 54*a*, and calculates the sucking superheating degree of the compressor 21*a* by subtracting the low pressure saturation temperature calculated from the sucking pressure, from the sucking temperature. Moreover, in the outdoor unit 2*b*, the CPU 110*b* calculates the sucking superheating degree of the compressor 21*b* similarly to the above, and periodically transmits the calculated sucking superheating degree to the outdoor unit 2*a* through the communication unit 130*b*. The oil recovery operation end condition is whether or not the sucking superheating degrees of the compressor 21*a* and the compressor 21*b* are both equal to or lower than a predetermined temperature, for example, equal to or lower than 0 degrees C. The predetermined temperature of the sucking superheating degree is previously obtained through a test or the like and determined, and is a temperature at which the refrigerant oil remaining in the refrigerant circuit is considered to be sucked into the compressors 21*a* and 21*b* together with the wet refrigerant.

The low pressure sensors 51*a* and 51*b* and the sucking temperature sensors 54*a* and 54*b* constitute the sucking superheating degree detecting means of the present invention.

At ST12, when the oil recovery operation end condition is not satisfied (ST12-No), the CPU 110*a* returns the process to ST11 to continue the reverse oil recovery operation. When the oil recovery operation end condition is satisfied (ST12-Yes), the CPU 110*a* advances the process to ST6.

At ST1, when the defrosting operation start condition is satisfied (ST1-Yes), the CPU 110*a* starts the defrosting operation preparation processing (ST2). Specifically, the CPU 110*a* stops the compressor 21*a* and the outdoor fan 24*a*, and as shown in FIG. 2, switches the four-way valve 22*a* so that the port a and the port b communicate and that the port c and the port d communicate in order that the outdoor heat exchanger 23*a* functions as a condenser. Then, the CPU 110*a* counts the time from the start of the defrosting operation preparation processing, and waits until a predetermined time (for example, three minutes) elapses from the start of the defrosting operation preparation processing. This predetermined time is a time necessary for the high pressure side and the low pressure side of the refrigerant circuit of the air conditioning apparatus 1 to be equalized, and is previously obtained through a test or the like and stored in the memory 120*a*.

On the other hand, the CPU 110*a* transmits a defrosting operation preparation processing signal to the outdoor unit 2*b* and the indoor units 8*a* to 8*d* through the communication unit 130*a*. The CPU 110*b* having received the defrosting operation preparation processing signal through the communication unit 130*b* stops the compressor 21*b* and the outdoor fan 24*b*, and as shown in FIG. 2, switches the four-way valve 22*b* so that the port e and the port f communicate and that the port g and the port h communicate in order that the outdoor heat exchanger 23*b* functions as a condenser. Then, the CPU 110*b* waits for an instruction from the CPU 110*a* of the outdoor unit 2*a*.

The controllers of the indoor units 8*a* to 8*d* having received the defrosting operation preparation processing signal from the outdoor unit 2*a* fully close the indoor expansion valves 82*a* to 82*d* and stop the indoor fans 83*a* to 83*d*. The controllers of the indoor units 8*a* and 8*b* performing the heating operation close the discharge valves 61*a* and 61*b* of the corresponding switching units 6*a* and 6*b* to prevent the refrigerant from flowing through the first flow dividing pipes 91*a* and 91*b*, and open the inlet valves 62*a* and 62*b* so that the refrigerant flows through the second flow dividing pipes 92*a* and 92*b* in order that the indoor heat exchangers 81*a* and 81*b* of the indoor units 8*a* and 8*b* function as evaporators. On the other hand, for the indoor units 8*c* and 8*d* performing the cooling operation, since the indoor heat exchangers 81*c* and 81*d* are in a state of functioning as evaporators, the condition of the switching units 6*c* and 6*d* is not changed.

The controllers of the indoor units 8*a* to 8*d* having performed the above-described processing waits for an instruction from the outdoor unit 2*a*.

The CPU 110*a* having finished the processing of ST2 starts the reverse defrosting operation (ST3). Specifically, the CPU 110*a* starts the compressor 21*a* with a predetermined number of rotations. Moreover, the CPU 110*a* transmits a reverse defrosting operation start signal to the outdoor unit 2*b* and the indoor units 8*a* to 8*d* through the communication unit 130*a*. The CPU 110*b* having received the reverse defrosting operation start signal through the communication unit 130*b* starts the compressor 21*b* with a predetermined number of rotations. The controllers of the indoor units 8*a* to 8*d* having received the reverse defrosting operation start signal from the outdoor unit 2*a* set the openings of the indoor expansion valves 82*a* to 82*d* to a predetermined one.

The CPU 110*a* having started the reverse defrosting operation at ST3 determines whether a defrosting operation end condition is satisfied or not (ST4). When the reverse defrosting operation is being performed, the CPU 110*a* periodically acquires the temperature of the outdoor heat exchanger 23*a* detected by the outdoor heat exchanger temperature sensor 57*a* and stores it in the memory 120*a*, and periodically acquires through the communication unit 130*a* the temperature of the outdoor heat exchanger 23*b* acquired from the outdoor heat exchanger temperature sensor 57*b* by the CPU 110*b* and stores it in the memory 120*a*. The defrosting operation end condition is whether or not the temperatures of the outdoor heat exchanger 23*a* and the outdoor heat exchanger 23*b* are both equal to or higher than a predetermined temperature, for example, equal to or higher than 5 degrees C. The predetermined temperature is previously obtained through a test or the like and determined, and is a temperature at which the frost adhering to the outdoor heat exchanger 23*a* and the outdoor heat exchanger 23*b* is considered to thaw.

At ST4, when the defrosting operation condition is not satisfied (ST4-No), the CPU 110*a* returns the process to ST3 to continue the reverse defrosting operation. When the defrosting operation condition is satisfied (ST4-Yes), the CPU 110*a* determines whether the oil recovery operation end condition is satisfied or not (ST5). When the oil recovery operation end condition is not satisfied (ST5-No), the CPU 110*a* returns the process to ST3 to continue the reverse defrosting operation. When the oil recovery operation end condition is satisfied (ST5-Yes), the CPU 110*a* resets the total operating time of the compressor 21*a*, and instructs the outdoor unit 2*b* to reset the total operating time of the compressor 21*b* (ST6).

As described above, when the air conditioning apparatus 1 starts the reverse defrosting operation, the reverse defrosting operation is continued until the defrosting operation end condition and the oil recovery operation end condition are both satisfied. As described above, since the operating state of the refrigerant circuit is the same between when the reverse defrosting operation is performed and when the reverse oil recovery operation is performed except for the operations of the outdoor fans 24*a* and 24*b*, a wet refrigerant flows in the refrigerant circuit also when the reverse defrosting operation is being performed, so that the refrigerant oil remaining in the refrigerant circuit can be recovered into the compressors 21*a* and 21*b*. Consequently, by continuing the reverse defrosting operation until the oil recovery operation end condition is satisfied, the recovery of the refrigerant oil into the compressors 21*a* and 21*b* can be performed.

Since the total operating times of the compressors 21*a* and 21*b* are reset when the reverse defrosting operation is ended, it never occurs that a shift is made to the reverse oil recovery operation immediately after the reverse defrosting operation is ended and the heating dominant operation is resumed. Consequently, the reverse defrosting operation and the reverse oil recovery operation can be prevented from being frequently performed, so that the heating dominant operation can be prevented from being frequently interrupted.

The CPU 110*a* having reset the total operating times of the compressors 21*a* and 21*b* at ST6 starts operation resumption processing (ST7). Specifically, the CPU 110*a* stops the compressor 21*a*, and as shown in FIG. 1, switches the four-way valve 22*a* so that the port a and the port d communicate and that the port b and the port c communicate in order that the outdoor heat exchanger 23*a* functions as an evaporator. Then, the CPU 110*a* counts the time from the start of the operation resumption processing, and waits until a predetermined time (for example, three minutes) elapses from the start of the operation resumption processing. This predetermined time is a time necessary for the high pressure side and the low pressure side of the refrigerant circuit of the air conditioning apparatus 1 to be equalized, and is previously obtained through a test or the like and stored in the memory 120*a*.

On the other hand, the CPU 110*a* transmits an operation resumption processing signal to the outdoor unit 2*b* and the indoor units 8*a* to 8*d* through the communication unit 130*a*. The CPU 110*b* having received the operation resumption processing signal through the communication unit 130*b* stops the compressor 21*b*, and as shown in FIG. 1, switches the four-way valve 22*b* so that the port e and the port h communicate and that the port f and the port g communicate in order that the outdoor heat exchanger 23*b* functions as an evaporator. Then, the CPU 110*b* waits for an instruction from the CPU 110*a* of the outdoor unit 2*a*.

The controllers of the indoor units 8*a* to 8*d* having received the operation resumption processing signal from the outdoor unit 2*a* start the processing for them to return to the operation mode interrupted by the reverse defrosting operation or the reverse oil recovery operation. The controllers of the indoor units 8*a* and 8*b* that were performing the heating operation before the interruption fully close the indoor expansion valves 82*a* and 82*d*, and stop the indoor fans 83*a* and 83*b*. Moreover, the controllers of the indoor units 8*a* and 8*b* open the discharge valves 61*a* and 61*b* of the corresponding switching units 6*a* and 6*b* so that the refrigerant flows through the first flow dividing pipes 91*a* and 91*b*, and close the inlet valves 62*a* and 62*b* to prevent the refrigerant from flowing through the second flow dividing pipes 92*a* and 92*b* in order that the indoor heat exchangers 81*a* and 81*b* of the indoor units 8*a* and 8*b* function as condensers. Then, the controllers of the indoor units 8*a* to 8*d* wait for an instruction from the outdoor unit 2*a*.

On the other hand, the controllers of the indoor units 8*c* and 8*d* that were performing the cooling operation before the interruption fully close the indoor expansion valves 82*c* and 82*d*, and waits for an instruction from the outdoor unit 2*a*. Although it is necessary for the indoor units 8*c* and 8*d* to cause the indoor heat exchangers 81*c* and 81*d* to function as evaporators at the time of the cooling operation, since the indoor heat exchangers 81*c* and 81*d* functioned as evaporators when the reverse defrosting operation or the reverse oil recovery operation was performed, it is unnecessary to change the condition of the switching units 6*c* and 6*d*.

The CPU 110*a* having finished the processing of ST7 resumes the heating dominant operation (ST8). Specifically, the CPU 110*a* starts the compressor 21*a* and the outdoor fan 24*a* with the number of rotations corresponding to the operating ability required by the indoor units 8*a* to 8*d*. Moreover, the CPU 110*a* transmits an operation resumption signal to the outdoor unit 2*b* and the indoor units 8*a* to 8*d* through the communication unit 130*a*. The CPU 110*b* having received the operation resumption signal through the communication unit 130*b* starts the compressor 21*b* and the outdoor fan 24*b* with the number of rotations corresponding to the operating ability required by the indoor units 8*a* to 8*d*. The controllers of the indoor units 8*a* to 8*d* having received the operation resumption signal from the outdoor unit 2*a* set the openings of the indoor expansion valves 82*a* to 82*d* to one corresponding to the operating ability required by the indoor units. Then, the CPU 110*a* having finished the processing of ST8 returns the process to ST1.

As described above, in the air conditioning apparatus of the present invention, since the state of the refrigerant circuit when the reverse defrosting operation is performed and the state of the refrigerant circuit when the reverse oil recovery operation is performed are the same, even if the temperature of the outdoor heat exchanger becomes equal to or higher than a predetermined temperature when the reverse defrosting operation is being performed, by continuing the reverse defrosting operation until the condition where it is considered that the refrigerant oil can be recovered is satisfied, that is, until the sucking superheating degree of the compressor becomes equal to or lower than a predetermined temperature, the refrigerant oil can also be recovered. Moreover, since the total time as the reverse oil recovery operation start condition is reset when the reverse defrosting operation is ended, the condition where the defrosting operation start condition and the oil recovery operation start condition are intermittently satisfied can be prevented from frequency occurring to frequently interrupt the heating operation, so that user comfort is not impaired.

What is claimed is:

1. An air conditioning apparatus comprising:

at least one outdoor unit including: a compressor; a flow path switching valve; an outdoor heat exchanger; outdoor heat exchanger temperature detecting means for detecting a temperature of the outdoor heat exchanger; and sucking superheating degree detecting means for detecting a sucking superheating degree as a superheating degree of a refrigerant sucked into the compressor;

a plurality of indoor units having an indoor heat exchanger;

a refrigerant circuit in which the at least one outdoor unit and the indoor units are alternately connected by a plurality of refrigerant pipes; and a controller configured to control the air conditioning apparatus such that when both the temperature of the outdoor heat exchanger detected by the outdoor heat exchanger temperature detecting means becomes equal to or higher than a first predetermined temperature and the sucking superheating degree detected by the sucking superheating degree detecting means becomes equal to or lower than a second predetermined temperature while a reverse defrosting operation to thaw frost forming on the outdoor heat exchanger by causing the outdoor heat exchanger to function as a condenser is being performed, the air conditioning apparatus ends the reverse defrosting operation, wherein the air conditioning apparatus ends the reverse defrosting operation when the temperature of the outdoor heat exchanger detected by the outdoor heat exchanger temperature detecting means is equal to or higher than the first predetermined temperature and, concurrently, the sucking superheating degree detected by the sucking superheating degree detecting means is equal to or lower than the second predetermined temperature.

2. The air conditioning apparatus according to claim 1, wherein the outdoor heat exchanger temperature detecting means is formed of an outdoor heat exchanger temperature sensor placed in the outdoor heat exchanger, and the sucking superheating degree detecting means is provided on a refrigerant pipe connected to a sucking side of the compressor, and is formed of a sucking temperature sensor that detects a temperature of the refrigerant sucked in the compressor and a low pressure sensor that detects a pressure of the refrigerant sucked in the compressor.

3. The air conditioning apparatus according to claim 1, wherein the air conditioning apparatus is configured to operate to recover a refrigerant oil discharged from the compressor and remaining in the refrigerant circuit into the compressor by causing the outdoor heat exchanger to function as a condenser every time a total operating time of the compressor becomes a predetermined time, and when the reverse defrosting operation is ended, the total operating time is reset.

4. The air conditioning apparatus according to claim 2, wherein the air conditioning apparatus is configured to operate to recover a refrigerant oil discharged from the compressor and remaining in the refrigerant circuit into the compressor by causing the outdoor heat exchanger to function as a condenser every time a total operating time of the compressor becomes a predetermined time, and when the reverse defrosting operation is ended, the total operating time is reset.

5. The air conditioning apparatus according to claim 1, the at least one outdoor unit further including a refrigerant temperatures sensor for detecting temperature of refrigerant flowing out of or into the outdoor heat exchanger.

6. The air conditioning apparatus according to claim 5, the at least one outdoor unit further including an outside air temperature sensor for detecting temperature of outside air flowing into the outdoor unit.

* * * * *